US011273540B2

(12) United States Patent
Andersson

(10) Patent No.: US 11,273,540 B2
(45) **Date of Patent: *Mar. 15, 2022**

(54) POWER WRENCH WITH ANGLE DRIVE

(71) Applicant: ATLAS COPCO INDUSTRIAL TECHNIQUE AB, Stockholm (SE)

(72) Inventor: Patrik Leander Andersson, Skogås (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 203 days.

This patent is subject to a terminal disclaimer.

(21) Appl. No.: 16/621,668

(22) PCT Filed: Jun. 1, 2018

(86) PCT No.: PCT/EP2018/064405
§ 371 (c)(1),
(2) Date: Dec. 11, 2019

(87) PCT Pub. No.: WO2018/228825
PCT Pub. Date: Dec. 20, 2018

(65) Prior Publication Data

US 2021/0146512 A1 May 20, 2021

(30) Foreign Application Priority Data

Jun. 12, 2017 (SE) ..... 1730159-9

(51) Int. Cl.
*B25B 23/00* (2006.01)
*B25B 13/48* (2006.01)
*B25B 21/00* (2006.01)

(52) U.S. Cl.
CPC ..... *B25B 23/0028* (2013.01); *B25B 13/481* (2013.01); *B25B 21/00* (2013.01)

(58) Field of Classification Search
USPC ..... 81/177.8, 57.11, 57.13, 57.29
See application file for complete search history.

(56) References Cited

U.S. PATENT DOCUMENTS 3,328,184 A * 6/1967 Weber ..... D21H 19/50 428/318.4
3,329,185 A * 7/1967 Hettich ..... B25B 21/00 81/58.1

(Continued)

FOREIGN PATENT DOCUMENTS

DE 102013218190 A1 3/2015
EP 0691185 A1 1/1996

(Continued)

OTHER PUBLICATIONS

International Search Report (ISR) and Written Opinion dated Sep. 17, 2018, issued in International Application No. PCT/EP2018/064405.

(Continued)

*Primary Examiner* — Joseph J Hail
*Assistant Examiner* — Dana Lee Poon
(74) *Attorney, Agent, or Firm* — Holtz, Holtz & Volek PC

(57) ABSTRACT

A power wrench includes a cylindrical housing, a motor, and an angle head attached to the housing and supporting an output shaft in a laterally extending position. The angle head is connected to the housing via a swivel coupling to enable rotation of the angle head and adjustment of the angular position of the output shaft relative to the housing. A releasable locking device is included between the angle head and the housing for arresting the angle head in alternative angular positions relative to the housing.

3 Claims, 3 Drawing Sheets

(56) References Cited

U.S. PATENT DOCUMENTS

| | | | | |
|---|---|---|---|---|
| 5,577,425 | A | 11/1996 | Holmin et al. | |
| 2004/0089528 | A1* | 5/2004 | Totsu | B25B 21/00 200/293.1 |
| 2007/0084310 | A1* | 4/2007 | Kobayashi | B25B 21/00 81/57.39 |
| 2009/0126960 | A1 | 5/2009 | Radif | |
| 2010/0163265 | A1* | 7/2010 | Hozumi | B25F 5/02 173/217 |
| 2010/0229691 | A1 | 9/2010 | Braendstroem et al. | |
| 2011/0259619 | A1 | 10/2011 | Brodin | |
| 2014/0133898 | A1 | 5/2014 | Tussing | |
| 2016/0288304 | A1 | 10/2016 | Shiao | |

FOREIGN PATENT DOCUMENTS

| | | | |
|---|---|---|---|
| EP | 2202035 | A2 | 6/2010 |
| EP | 2367658 | A1 | 9/2011 |
| WO | 2007129957 | A1 | 11/2007 |
| WO | 2009051543 | A1 | 4/2009 |

OTHER PUBLICATIONS

International Search Report (ISR) and Written Opinion dated Oct. 1, 2018, issued in International Application No. PCT/EP2018/064403.

Related U.S. Appl. No. 16/621,658, First Named Inventor: Patrik Leander Andersson; Title: "Power Wrench With Adjustable Trigger Position"; Filed: Dec. 11, 2019.

* cited by examiner

POWER WRENCH WITH ANGLE DRIVE

The invention relates to a power wrench comprising a cylindrical housing, a motor, and an angle head supported on the housing and including a laterally extending output shaft. The housing is understood to be cylindrical in its entirety or cylindrical in those areas where needed to facilitate the use and function of rotation of the tool angle head.

In prior art power wrenches of the above type there is encountered a handling problem at screw joint tightening operations where some screw joints are located in a difficult to reach positions. A contributory reason for that is the direction of the output shaft in relation to the power wench housing, which means that when trying to get access to an awkwardly positioned screw joint some part or parts of the wrench housing may get into contact with the structure on which the screw joint is situated, thereby obstructing the wrench from reaching a proper working position.

In battery powered wrenches in particular there may be a problem to get access to some screw joint positions due to the rather bulky and laterally extending battery package attached to the wrench housing in combination with the direction of the output shaft.

Apart from having problem with getting access to difficult to reach screw joint positions some screw joint positions may also cause uncomfortable and tiresome working postures for the operator. At power wrenches having a power controlling trigger supported on the housing such situations may be aggravated by the position of the trigger on the housing in relation to the angular position of the output shaft. This may necessitate the operator to take an awkward posture to be able to support the wrench properly and at the same time be able to manoeuver the trigger. Accordingly, the relative trigger and angle head positions on the housing may cause an undesirable working situation from an ergonomic point of view.

It is an object of the invention to address the above mentioned problem of getting access to difficult to reach screw joint positions by avoiding obstruction by parts of the wrench housing interfering with parts of the structure on which the screw joint is situated.

It is a further object of the invention to facilitate handling of a power wrench at tightening of screw joints in positions causing awkward working postures for the operator.

One of the above objects of the invention is reached by providing a power wrench having a cylindrical housing, a motor, and an angle head connected to the housing and supporting a laterally extending output shaft, wherein the angle head is connected to the housing via swivel coupling so as to enable adjustment of the angular position of the output shaft relative to the housing.

Another object of the objects of the invention is reached by providing a power wrench having a cylindrical housing, a motor, a trigger supported on the housing and arranged to activate a power control device, and an angle head attached to the housing and including a laterally extending output shaft, wherein the trigger is supported on the housing via a ring element which is rotatable relative to the housing for enabling adjustment of the angular position of the trigger relative to the housing.

Further objects and advantages of the invention will appear from the following specification and claims.

A preferred embodiment of the invention is described below with reference to the accompanying drawing.

In the drawing

Figure 1:
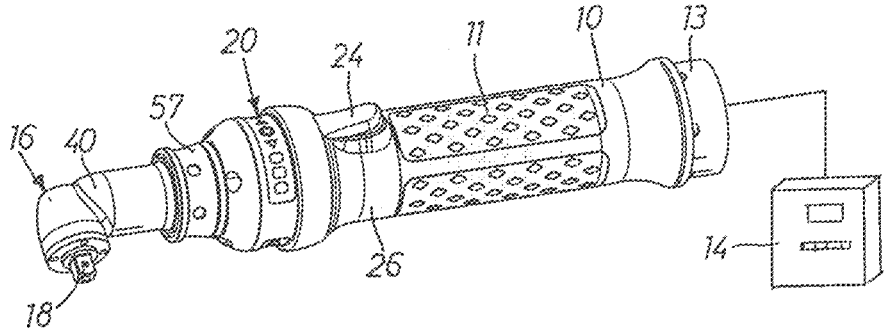
FIG. 1 shows a perspective view of a power wrench according to one embodiment of the invention.

The power wrench illustrated in FIG. 1 comprises a cylindrical housing 10 formed with a tubular handle 11 and supporting a non-illustrated electric motor. At its rear end the housing 10 provided with a connection socket 13 for connection of a power and signal transferring cable communicating with a separate programmable operation control unit 14. The properties and operation order of the control unit is of a well known type and does form any part of the present invention. Therefore it is not illustrated in further detail.

At its forward end the housing 10 carries an angle head 16 with a square ended output shaft 18 adapted to carry a nut socket. The output shaft 18 extends in a lateral direction perpendicularly to the cylindrical housing 10 and is connected to the motor via an angle drive. The angle head 16 is connected to the housing 10 via a swivel coupling 20 for enabling setting of the angle head 16 in a number of alternative angular positions relative to the housing 10 such that the output shaft 18 may be directed in alternative angular dispositions relative to the housing 10.

The angle head 16 carried at the forward end of the housing 10 comprises a casing 40 wherein a drive pinion 41 and the output shaft 18 are journalled. The drive pinion 41 is supported in a forward bearing 42 and a rear bearing 43, whereof the rear bearing 43 is a ball bearing with an outer race 45 is supported in a tubular neck portion 46 of the angle head casing 40.

Figure 2:
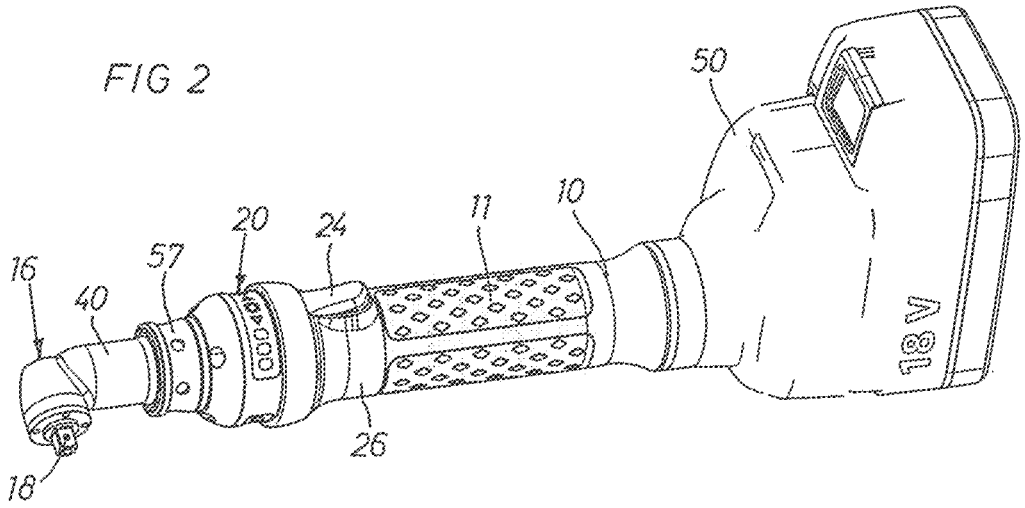
FIG. 2 shows a perspective view of a power wrench according to an alternative embodiment of the invention.

In FIG. 2 there is illustrated a battery powered power wrench wherein the rather bulky battery package 50 although it makes the wrench freely movable without cable connection still causes occasional problems at getting access to difficult to reach screw joint locations. In this type of wrenches there is a particular need for having the angle head 16 adjustable to get a favourable direction of the output shaft 18. In a less favourable direction of the output shaft 18 there is a risk that the battery package will get into contact with the structure adjacent the screw joint to be tightened and obstruct a proper wrench position.

Accordingly, it is an essential feature to have the angle head 16 rotatable and possible to be set in alternative angular positions relative to the housing 10. As illustrated in FIGS. 6-9 the neck portion 46 of the angle head casing 40 is freely rotatable relative to a mounting sleeve 51 which is rigidly connected to the wrench housing 10 via an inner thread 52. The neck portion 46 is provided with a row of indentations 53 distributed around its periphery, and a couple of balls 54 are provided to engage those indentations 53. This ball/indentation arrangement forms a locking device 55 by which the angle head 16 is lockable in alternative angular positions relative to the housing 10. The balls 54 are radially movable within apertures 56 in the mounting sleeve 51, and a surrounding manoeuver sleeve 57 is axially displaceable between a rear lock position in which the balls 54 are blocked from leaving the indentations 53 and a release position wherein the balls 54 are free to move out of the indentations 53 and unlock the angle head 16 for rotation relative to the mounting sleeve 51 and the housing 10. A number of springs 59 are provided to exert a bias force on the manoeuver sleeve 57 towards the lock position. The axial movement of the manoeuver sleeve 57 is limited by two lock rings 61, 62 mounted on the neck portion 46 of the angle head casing 40.

When it becomes necessary to change the angular position of the angle head 16 relative to the housing 10 to thereby facilitate accessibility to difficult to reach screw joint locations the manoeuver sleeve 51 is pulled forwardly against the bias force of the springs 59 wherein the balls 54 are free to leave their locking engagement with the indentations 53. Now the angle head 16 is unlocked relative to the housing 10 and could be rotated to a desired angular position. When that is done the manoeuver sleeve 51 is allowed to return to its lock position by the force of the springs 59, wherein the balls 54 reengage the indentations 53 and lock the angle head 10 against rotation.

A trigger 24 is provided on the housing 10 for manual control of the power supply to the motor. The trigger 24 is carried by an annular sleeve element 26 which is freely rotatable relative to the housing 10. By provision of the trigger 24 on a rotatable sleeve element 26 it is possible to rotate the trigger 24 into angular positions favourable for manoeuvring the trigger 24 also in awkward operation positions, especially with reference to the actual angular position of the angle head 16.

Figure 3:
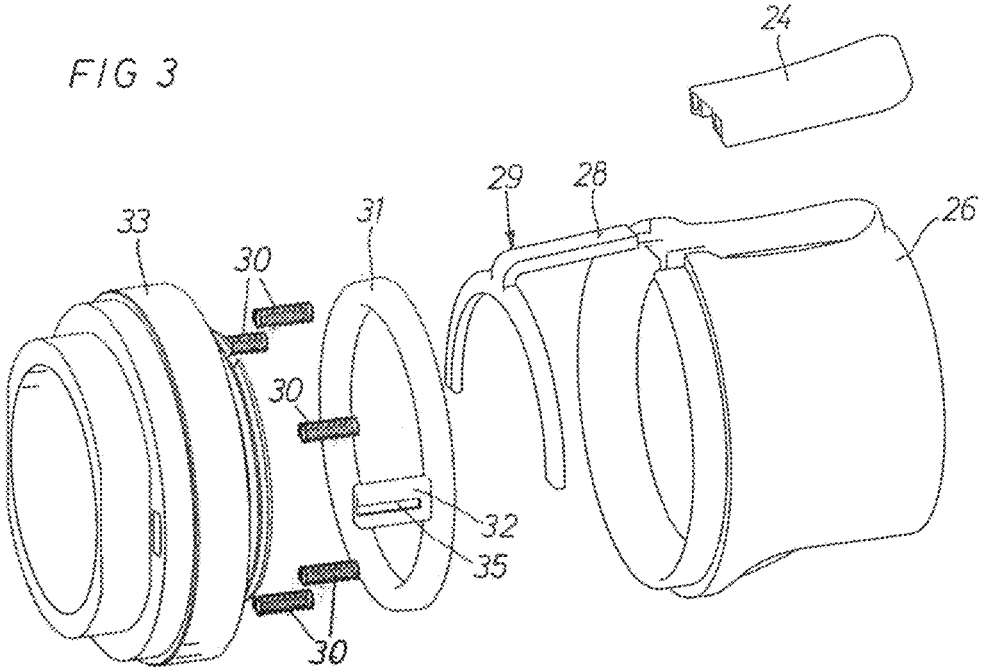
FIG. 3 shows on a larger scale an exploded view of a trigger arrangement according to the invention.
Figure 4:
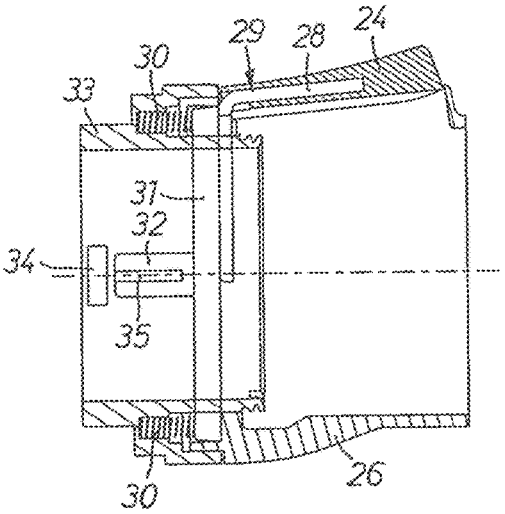
FIG. 4 shows a longitudinal section of an assembled trigger arrangement of FIG. 3 illustrating an inactive position of the trigger.
Figure 5:
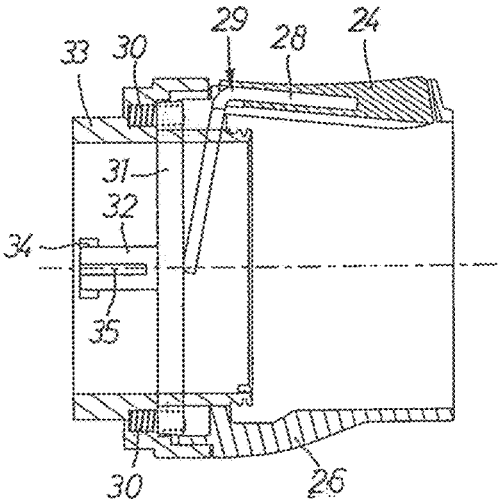
FIG. 5 shows a similar section as FIG. 4 but illustrates the trigger in its activated position.
Figure 6:
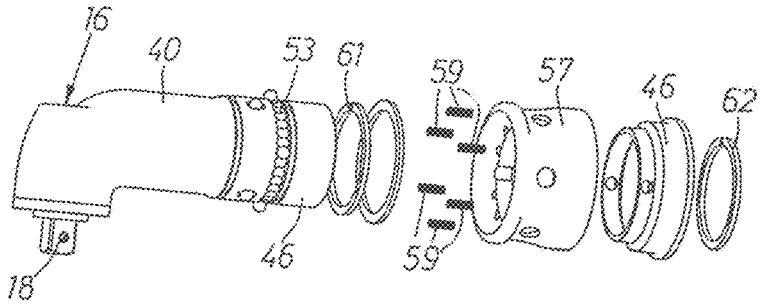
FIG. 6 shows an exploded perspective view of an angle head arrangement according to the invention.
Figure 7:
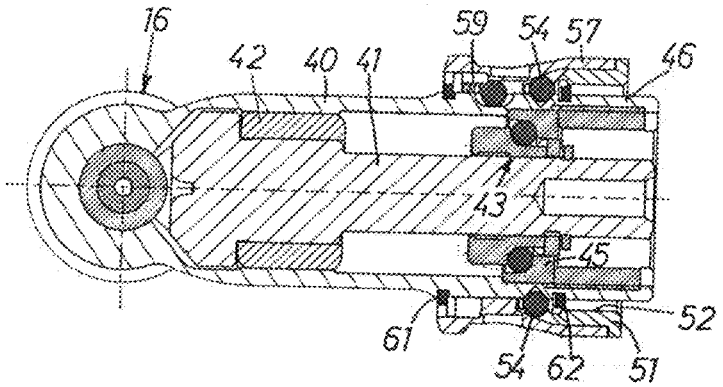
FIG. 7 shows a longitudinal section of the angle head in FIG. 6 illustrating a lock position of the angle head locking device.
Figure 8:
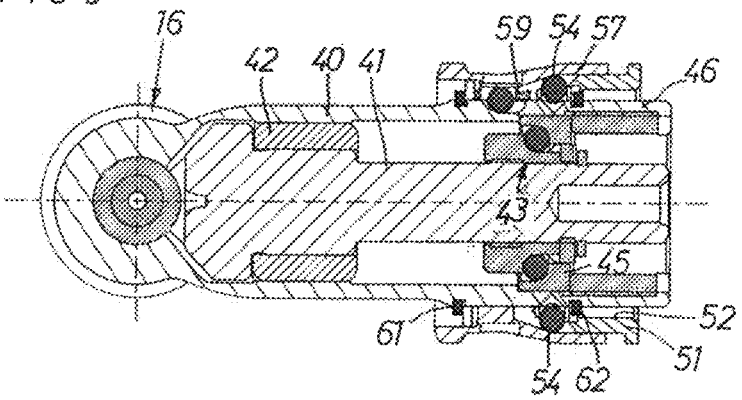
FIG. 8 shows a similar section as FIG. 7 but illustrates a release position of the angle head locking device.
Figure 9:
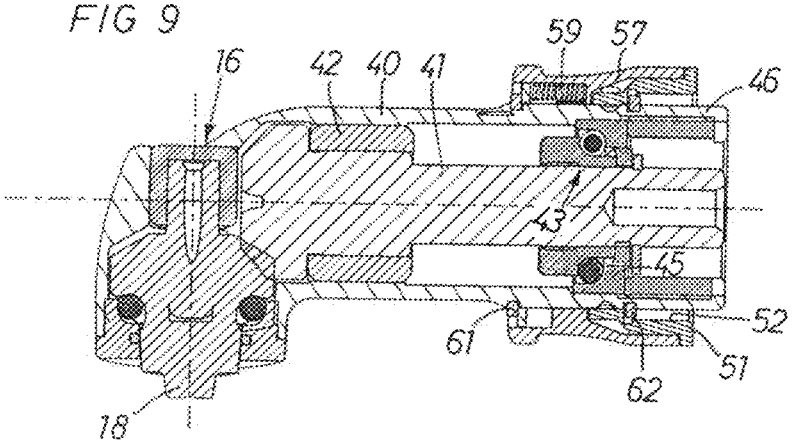
FIG. 9 shows an alternative section of the angle head illustrated in FIGS. 6-8.

As illustrated in FIGS. 3-5 the trigger 24 is mounted on an arm 28 of a fork 29 which is pivotally supported on the sleeve element 26. The fork 29 is arranged to cooperate with an activation ring 31 coaxial with the housing 10 and formed with an axially protruding finger 32. The activation ring 31 is supported on and axially displaceable relative to a support sleeve 33 secured in the housing 10, and springs 30 are provided to bias the activation ring 31 towards a rear inactivated position. The support sleeve 33 carries a Hall element 34 acting as an activation means for accomplishing shifting of a non-illustrated power switching device, wherein activation of the Hall element 34 is accomplished by a magnet 35 carried on the finger 32 of the activation ring 31.

In FIG. 4 the trigger 24 as well as the activation ring 31 are illustrated in their rest positions retracted by the springs 30. In this position of the activation ring 31 the magnet 35 is out of cooperation with the Hall element 34 and no signal is emitted to activate the power switch.

In FIG. 5 the trigger 24 has been pressed down to an activated position thereby making the fork 29 displace the activation ring 31 forwards to a position where the Hall element 34 is activated by the magnet 35. This results in a signal being emitted by the Hall element 34 to activate the power switching device and start the wrench for operation.

The activation ring 31 is not rotatable relative to the housing 10 but has a fixed annular position with the finger 32 in constant position for cooperation with the Hall element 34. The annular sleeve element 26 on which the trigger 24 is supported is freely rotatable relative to the housing 10, but due to the arrangement with the trigger 24 mounted on the fork 29 the activation ring 31 may be displaced into its active position independently of the actual angular position of the trigger 24.

By the angle head arrangement according to the invention there is provided a power wrench by which the operator is offered the possibility to easily and readily adapt the wrench to various working conditions to thereby obtain proper tool positions even in difficult to reach locations and at the same time avoid awkward and tiresome working postures.

It is to be understood that the embodiments of the invention are not limited to the described and illustrated examples but may be freely varied within the scope of the claims.

The invention claimed is:

1. A power wrench comprising:

a cylindrical housing;

a motor; and an angle head attached to the housing and supporting an output shaft in a laterally extending position, wherein:

the angle head is connected to the housing via a swivel coupling to enable rotation of the angle head and adjustment of an angular position of the output shaft relative to the housing, the housing comprises a power switching device, a manually operated trigger is located on the housing and arranged to activate the power switching device, the trigger is supported on an annular sleeve element, the sleeve element is rotatable relative to the housing to enable adjustment of an angular position of the trigger relative to the housing, the trigger is arranged to activate the power switching device via an axially displaceable activation ring, the power switching device is configured to be activated by a Hall element activated by a magnet supported on the activation ring, and the trigger is arranged to displace the activation ring via a fork.

2. The power wrench according to claim 1, wherein a locking device is arranged between the angle head and the housing for locking the angle head in alternative angular positions.

3. The power wrench according to claim 2, wherein the locking device comprises a maneuver sleeve arranged to be axially shiftable between a lock position and a release position, and at least one spring is arranged to bias the maneuver sleeve towards the lock position.

* * * * *